US009925097B2

(12) United States Patent
Yancovitch et al.

(10) Patent No.: US 9,925,097 B2
(45) Date of Patent: Mar. 27, 2018

(54) PORTABLE STRETCHER

(71) Applicant: Easy Rescue, Ramat Efal (IL)

(72) Inventors: Avraham Yancovitch, Rehovot (IL); David Daboush, Tel Aviv (IL)

(73) Assignee: EASY RESCUE, Ramat Efal (IL)

( * ) Notice: Subject to any disclaimer, the term of this patent is extended or adjusted under 35 U.S.C. 154(b) by 0 days.

(21) Appl. No.: 14/033,875

(22) Filed: Sep. 23, 2013

(65) Prior Publication Data

US 2015/0082544 A1 Mar. 26, 2015

(51) Int. Cl.

| | |
|---|---|
| ***A61G 1/017*** | (2006.01) |
| ***A61G 1/01*** | (2006.01) |
| ***A61G 1/044*** | (2006.01) |
| ***A61G 1/048*** | (2006.01) |

(52) U.S. Cl.

CPC ..... *A61G 1/017* (2013.01); *A61G 1/01* (2013.01); *A61G 1/044* (2013.01); *A61G 1/048* (2013.01); *A61G 2200/32* (2013.01); *A61G 2200/34* (2013.01)

(58) Field of Classification Search

CPC ..... A61G 1/00
USPC ..... 5/625–628, 81.1 R, 81.1 T
See application file for complete search history.

(56) References Cited

U.S. PATENT DOCUMENTS

| | | | | |
|---|---|---|---|---|
| 1,849,864 | A * | 3/1932 | Frederick | 294/140 |
| 6,477,728 | B1 * | 11/2002 | Faz | 5/625 |
| 8,336,141 | B2 * | 12/2012 | Wong | 5/627 |
| 2002/0162171 | A1 * | 11/2002 | Faz | A61G 1/017 5/627 |
| 2009/0038076 | A1 * | 2/2009 | Giduck | A61G 1/01 5/627 |
| 2009/0313759 | A1 * | 12/2009 | Wong | A61G 1/01 5/627 |

* cited by examiner

*Primary Examiner* — Fredrick C Conley
(74) *Attorney, Agent, or Firm* — Celia H. Leber; Leber IP Law

(57) ABSTRACT

A portable stretcher for carrying a subject that includes a support member for supporting a subject's body made of a flexible material; carrying straps connected to opposite sides of the support member at a back side thereof, for allowing manually carrying the stretcher; and at least two sets of handles each set comprising at least one handle, wherein each of the handles connects to the support member. The stretcher is configured for carrying the subject in a sitting posture by having at least two carriers wearing the carrying straps and also in a laying posture, in which the subject horizontally lays over the support member by having the carriers carry the laying subject by using the handles.

14 Claims, 4 Drawing Sheets

PORTABLE STRETCHER

FIELD OF THE INVENTION

The present invention generally relates to stretchers and/or rescue baskets, blankets or evacuation harness.

BACKGROUND OF THE INVENTION

Stretches (also called litters) are used to carry injured people to safety places where the carried person can receive medical or any other suitable treatment. The stretcher is typically designed to be carried by two people and therefore, usually includes a fabric sheet stretched over two parallel holding bars. Most modern stretchers include one or more security belts for securing the patient's body to the stretcher.

Stretchers used in ambulances include a mattress bed-like part connected to a foldable wheels structure that immediately opens once pulled from the ambulance allowing the paramedics to carry patients of various conditions and weights and through various surfaces relatively easily.

Portable stretchers, such as evacuation blankets, designed for traveling long distances and/or rough terrains, are light weighted and often can be folded to a fairly compact and comfortable size for easy carrying. To allow folding, portable stretchers often have telescopic stretcher-bars that can also be removed from the cloth connecting them so that the cloth can be folded in the traveler's bag and the bars collapse into a significantly smaller size.

In some medical cases the patient should be carried in a laying position where in other cases the patient should or can be carried in a sitting position or semi-sitting position. Evacuation blankets and/or evacuation harnesses or carriers allow rescuing of subjects from difficult locations requiring rescue vehicles such as helicopters and the like or require climbing facility and staff such as rescue through abseiling and the like. These rescue blankets include a sheet of fabric and often some handles attached thereto, where carriers such as back carriers can include straps through which the subject is harnessed to the rescuer or to a rope for lifting him/her to the helicopter or for carrying him/her through an abseiling rope.

SUMMARY OF THE INVENTION

According to some embodiments of the present invention, there is provided a portable stretcher for carrying a subject that comprises: a support member for supporting a subject's body, where the support member is made of a flexible material; at least two carrying straps connected to opposite sides of the support member for allowing manually carrying the stretcher; and at least two sets of handles each set comprising at least one handle, wherein each the handle connects to the support member. The stretcher is configured for carrying the subject in: (i) a sitting posture by having at least two carriers wearing the carrying straps; and (ii) a laying posture, in which the subject horizontally lays over the support member by allowing the carriers to carry the laying subject by using the handles.

Optionally, the support member is made of fabric or cloth.

Additionally or alternatively, the handles are made of a flexible material such as fabric or rope etc.

According to some embodiments, the support member has parts that can fold and attach to one another in a folded position for adjusting the length of the support member to the stretcher positions, wherein in a sitting position the support member is shorter than in a laying position thereof, the folded parts are releasably attached from one another by using attaching means such as hook-and-loop (e.g. Velcro) fasteners.

The support member may have a section thereof that is configured in a trapeze shape to provide optimal load balance when supporting the subject's back or neck.

According to some embodiments of the present invention, the support member comprises three sections a first section, a second section connected thereto and a third section connected to the middle section and the stretcher comprises three handle sets each the handle set comprises two handles attached to the sides of the support members, wherein the first two handles of the first handle set are located an edge of the first section, the handles of the second handle set are located at sides of the middle section and the handles of the third handle set are located at sides of the third section. There might be handles attached to the top and/or the bottom of the stretcher (one or more in each side).

Optionally, each carrying strap comprises a length adjustment mechanism (such as a buckle) for allowing the carriers to adjust the length of the respective carrying strap according to their size and/or according to the required stretcher position. The stretcher may further include shoulder caps each the shoulder cap is configured for cladding each respective carrying strap.

The stretcher optionally includes at least one fastening belt for securing the body of the subject to the support member. Each fastening belt may include an adjustment mechanism such as a buckle for adjusting the length thereof. For example, the portable stretcher includes at least one of: a main fastening belt for securing a subject's torso to the support member; two leg fastening belts for securing each of the subject's legs to the support member.

DETAILED DESCRIPTION OF THE INVENTION

Figure 1:
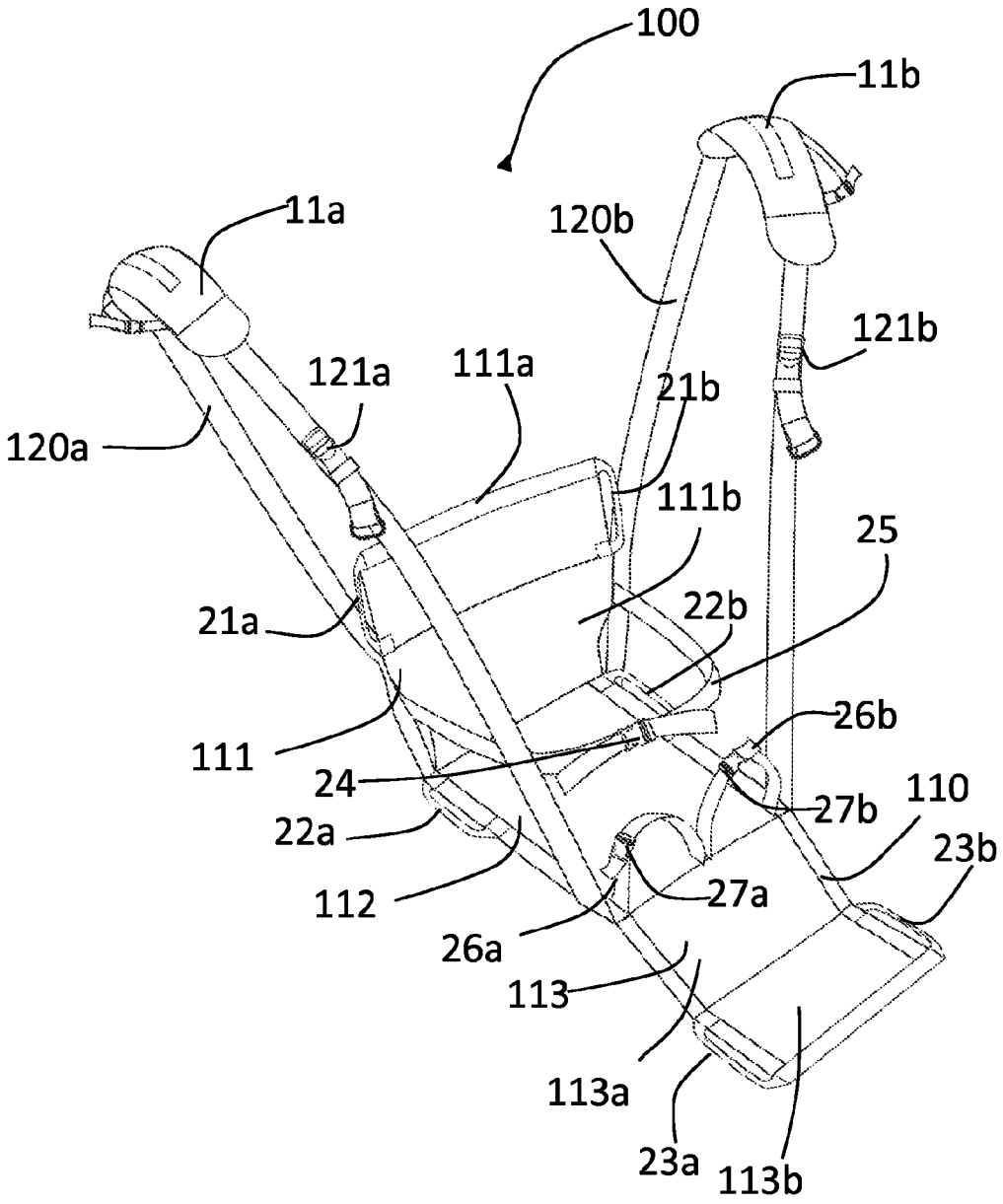
FIG. 1 shows an isometric view of a portable stretcher in a sitting position, according to some embodiments of the present invention.

In the following detailed description of various embodiments, reference is made to the accompanying drawings that form a part thereof, and in which are shown by way of illustration specific embodiments in which the invention may be practiced. It is understood that other embodiments may be utilized and structural changes may be made without departing from the scope of the present invention.

The present invention, in some embodiments thereof, provides a light weight portable stretcher for carrying subjects such as people who are injured or cannot support themselves for any other reason, in various body postures mainly for allowing easily laying or seating the subject therein and for carrying the subject thereby. The stretcher allows adjusting in configuration to two or more positions for supporting the subject's body in a bodily posture that is most suitable to his/her medical and/or physical condition and/or according to the evacuation conditions.

The term "evacuation condition" refers to the environmental conditions under which the subject has to be evacuated depending on, for example, road conditions, emergency conditions and the like. For example, if the subject has to be evacuated by taking him/her through a narrow pathway or a narrow staircase, the sitting posture (if the physical condition of the subject allows it) may be the best option for the ones carrying the stretcher and subject (also referred to hereinafter as "carriers") helping them to evacuate the subject in the easiest and quickest manner. In another example, under a fire emergency situation, the sitting posture may also be the optimal evacuation position for the carriers, provided that the physical condition of the subject allows this posture. The stretcher allows the carriers thereof to carry the stretcher while positioned in a raw in which one carrier is at the side of the other carrier, where the two carriers are each at a different side of the subject as well as in a line in which the two carriers are walking one in front of the other where one faces the back of the other for allowing evacuation through narrow pathways.

According to some embodiments of the present invention, the portable stretcher includes an adjustable support member, which may be a single piece of a light weight fabric (sheet) such as a tent cloth for supporting a subject's body; at least two carrying straps connected the support member; and at least two handle sets that also connect to the support member. The carrying straps may be used either for carrying the subject in the sitting position or in a laying position and the handles may be used in addition to the straps for carrying the subject in the laying position.

According to some embodiments of the present invention, the support member has a rectangular shape having four edges, where each of the handles may be attached to each edge side of the support member. In this configuration, each of two carriers will be required to hold a pair of handles at each end of the support member to allow laying the subject thereover in the laying posture, while the straps may either be left unused or used for additional support where each carrier wears a strap over his/her shoulder.

In the sitting position the carriers are not required to use their hands to carry the stretcher and therefore can use their hands for balancing and supporting themselves when carrying the subject. This may be extremely useful when carrying the stretcher and subject sitting therein under complicated environmental evacuation conditions such as stiff and/or rocky roads or stiff and narrow staircases, through crowded places and the like. In the laying position, since the carriers can still use the carrying straps, they can also use at least one of their hands for supporting them when evacuating the subject.

According to some embodiments of the present invention, the carrying straps may have a length adjustment mechanism such as a buckle for enabling adjustment of the straps' length according to the evacuator's size (i.e. height) and according to the wearing thereof. For example, to wear the strap in a position in which the strap is hung over the evacuator's neck may require a different length than for wearing the strap in a position in which it diagonally hangs over the neck and shoulder of the evacuator.

The stretcher may optionally also include means for securing the subject to the stretches such as adjustable safety belts having buckles for allowing securing the subject to the stretcher and fitting the length of the belts to the size of the subject.

According to some embodiments of the present invention, the support member, carrying straps as well as the handles and security belts may all be made of elastic materials such as fabric/cloth to allow the stretches to easily fold to fit a small size carrying bag, which may or may not be connected to the support member.

Figure 2:
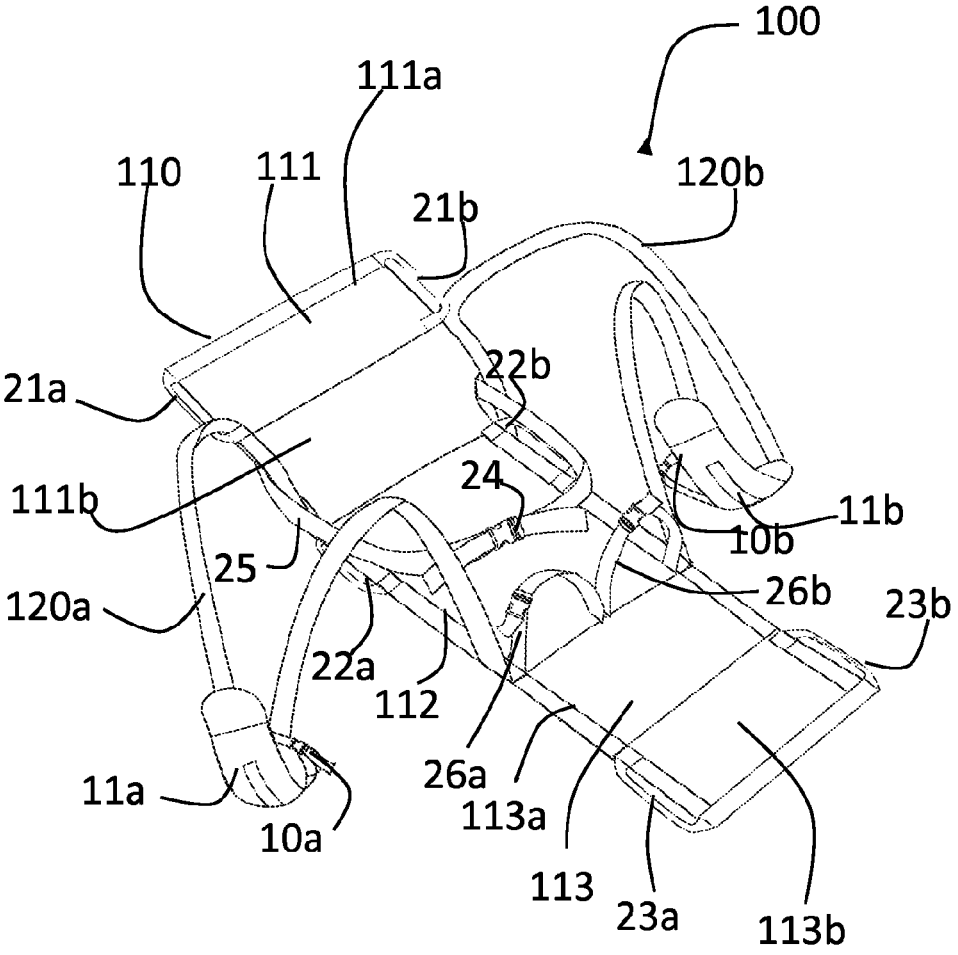
FIG. 2 shows an isometric view of the portable stretcher of FIG. 1 in a laying position, according to some embodiments of the present invention.

Reference is now made to FIG. 1 and FIG. 2, schematically illustrating a portable stretcher 100, according to some embodiments of the present invention. FIG. 1 shows the portable stretcher 100 in a sitting position while FIG. 2 shows the portable stretcher 100 in a laying position.

The portable stretcher 100 includes a support member 110; two carrying straps 120*a* and 120*b* each having a respective buckle 121*a* and 121*b*; six handles: 21*a*-21*b*, 22*a*, 22*b*, 23*a* and 23*b*; and three fastening belts: torso fastening belt 25 having a buckle 24 and two leg belts 26*a* and 26*b* having respective buckles 27*a* and 27*b*. The buckles 121*a*, 121*b*, 24, 27*a* and 27*b* allow adjusting the length of the straps 120*a* and 120*b* and belts 25, 26*a* and 26*b*, respectively.

Each carrying strap 120*a*/120*b* connects to a different side of the support member 110 for allowing carriers who carry the stretcher (e.g. two carriers) to carry the subject using the portable stretcher 100 by placing each carrying strap 120*a*/120*b* over their opposite shoulder (the shoulder that is far from the subject), where each carrier should wear one of the carrying straps 120*a*/120*b*.

As illustrated in FIGS. 1-2, the support member 110 includes three main sections: an upper section 111, for supporting the subject's upper or entire torso and head; a middle section 112 for supporting the subject's lower torso and/or upper legs part; and a lower section 113 for supporting the subject's lower legs part including his/her feet. The three sections 111-113 can be parts of a single fabric support member 110, where stitch lines or draw lines indicate the separation of the support member 110 into these sections. The indicated sections may help users to fold the stretcher 100 back into a folded compact position for carrying thereof when not in use into a small bag.

According to some embodiments, as illustrated in FIGS. 1-2, the upper section 111 includes two parts connected to one another: a first part 111*a* and a second part 111*b*. These parts 111*a* and 111*b* can be folded to adjust the stretcher 100 to a sitting position so that the length of support member 110 is shortened to adjust in length for a subject to sit thereover. According to some embodiments of the present invention, as illustrated in FIG. 3B, the support member 110 includes reclosable attaching members at its back side such as dual lock reclosable fasteners (such as VELCRO® hook-and-loop fasteners) allowing to attach these parts 111*a* and 111*b* to shorten the support member 110 length for adjusting it to a sitting position.

Similarly, the lower section 113 may also be divided into two parts: a first part 113*a* and a second part 113*b*, where these parts 113*a* and 113*b* can be folded to adjust the stretcher 100 to a sitting position so that the support member's 110 length is further shortened to adjust in length for a subject to sit thereover by also using reclosable attaching members for folding these parts 113*a* and 113*b* and keeping them folded by attaching them together in a manner that allows reattaching them again for lengthening the support member 110 again for adjusting it to the subject's height and/or for adjusting it to the laying position.

According to some embodiments of the present invention, as shown in FIGS. 1-2, the second part 111*b* of the first section 111 has a trapeze shape to provide optimal load balance when supporting the subject's back or neck. The straps 120*a* and 120*b* connect to the back side of the middle section 112 of the support member 110. The trapeze shape of the second part 111*b* of the first section 111 and the connection location of the straps 120*a* and 120*b* helps preventing the stretcher 100 from being tilted to the sides by facilitating in centralizing the subject's weight when the subject is carried allowing each carrier to be able to stabilize himself/herself.

As illustrated in FIGS. 1-2, the first set of handles 21*a* and 21*b* connect to the sides of a proximal edges of the first part 111*a* of the first section 111 that is configured for holding the head and neck area of the subject to allow at least one of the carriers to grab thereto for carrying the subject in the laying position. The second set of handles 22*a* and 22*b* are attached to the sides of at the middle section 112 for allowing additional support to the subject's torso or pelvic area when carrying him/her. The third set of handles 23*a* and 23*b* connect to the distal edge of the lower section 113 for allowing the carrier to support the legs part of the subject when carrying him/her.

The handles 21*a*-23*b* extend outwardly from the edges of the support member 110 as shown in FIGS. 1-2 or may alternatively be made by placing openings in the fabric support member 110. Additional handles are optional.

The handles 21*a*-23*a* and 21*b*-23*b* may be made from any material known in the art whether ridged such as metal, plastic wood, etc. or flexible materials such as fabric, rope, elastic bands and the like.

According to some embodiments, as illustrated in FIGS. 1-2, the length of the carrying straps 120*a* and 120*b* of the portable stretcher 100 may be adjustable. Each of the straps 120*a*/120*b* includes one or more buckles such as buckles 121*a* and 121*b* for allowing adjusting its length. The portable stretcher 100 may further include shoulder caps such as shoulder caps 11*a* and 11*b* (as illustrated in FIGS. 1-2), each such shoulder cap 11*a*/11*b* is configured for cladding each respective carrying strap 120*a*/120*b*.

Figure 3A:
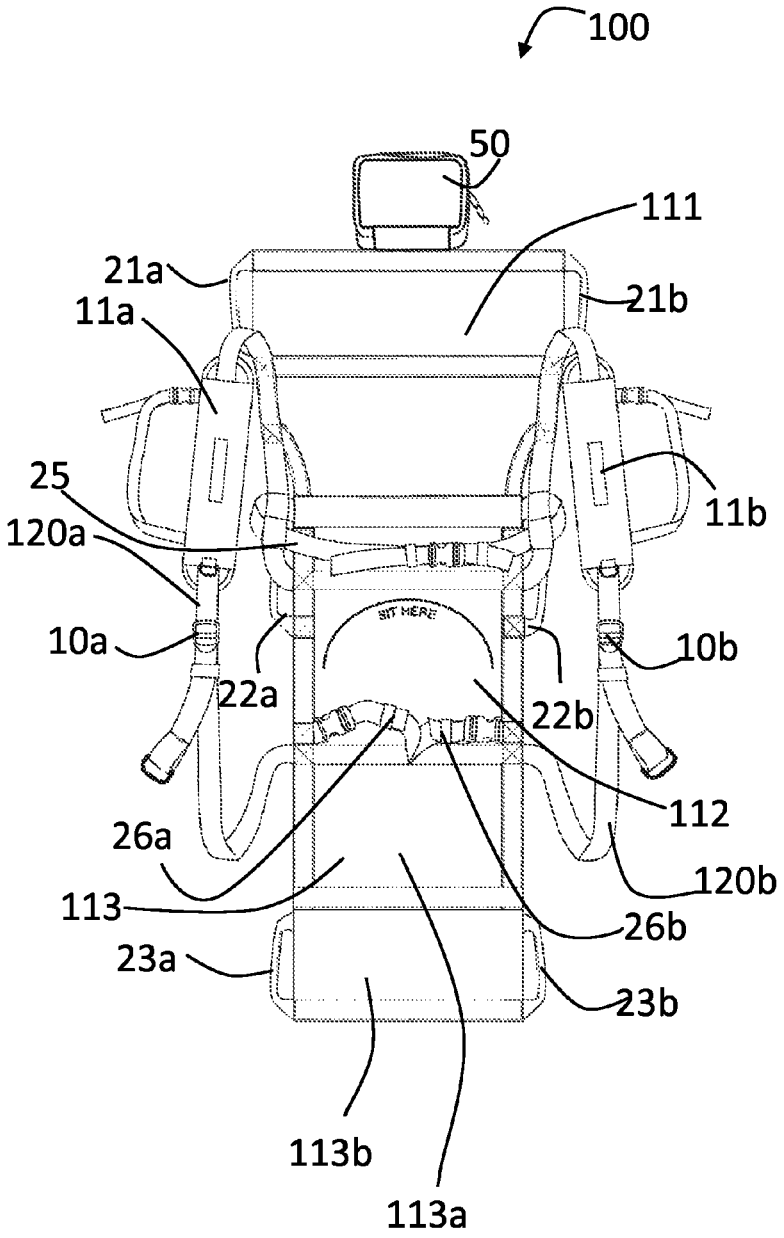
FIG. 3A shows a frontal view of the portable stretcher, according to some embodiments of the present invention.
Figure 3B:
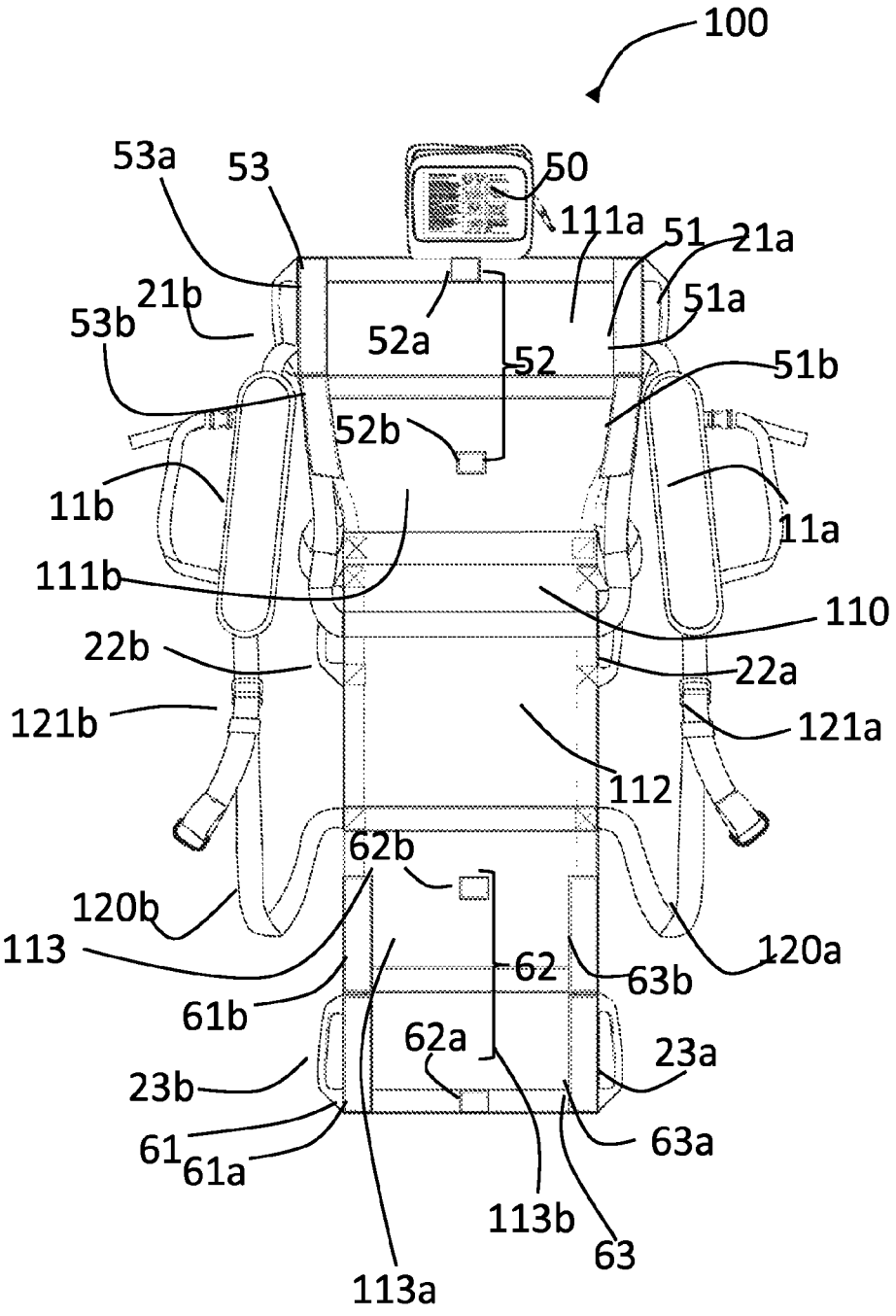
FIG. 3B shows a rear view of the portable stretcher, according to some embodiments of the present invention.

Reference is now made to FIGS. 3A and 3B, schematically illustrating front and back views of the portable stretcher 100 as described in reference to FIGS. 1-2 having an additional attachment 50 made from flexible materials such as fabric including instructions as to how to use, adjust and fold the portable stretcher 100 printed thereover.

FIG. 3B also shows reclosable hook-and-loop fasteners 51-5 and 61-63 of the support member 110 attached at the back of the upper and lower sections 111 and 113, respectively of the support member 110 for attaching the first part 111*a*/113*a* thereof to the second part 111*b*/113*b* in a reclosable and removable manner. Each hook-and-loop faster such has respective hook member and loop member configured to releasably attach to one another for holding the respective section of the support member 110 folded. FIG. 3B illustrates how the upper section 111 includes three hook-and-loop fasteners 51, 52 and 53 each has a hook member 51*a*, 52*a* and 53*a* and respective loop member 51*b*, 52*b* and 53*b*, and the lower section 113 includes three hook-and-loop fasteners 61, 62 and 63 each has a hook member 61*a*, 62*a* and 63*a* and respective loop member 61*b*, 62*b* and 63*b*.

The portable stretcher 100 may be designed in shape and dimensions to fit one or more standard wheel chairs when in the sitting position to allow seating the subject in a wheel chair easily without having to lift the subject out of the stretcher for placing him/her in the wheel chair. This may help the carriers when reaching their destination (e.g. a clinic, hospital or any other designated location) in cases where the subject has to be further moved by using a wheel chair.

The portable stretcher 100 may be configured to allow easy and comfortable carrying thereof by allowing the carriers to either carry the subject in a column carrying position, in which the carriers are both facing the facing direction of the subject seated thereover or in a sided position facing one another perpendicular to the direction of movement.

According to some embodiments, in the laying position, where the subject is in a laying posture, a first carrier may hold the first set of handles 21*a* and 21*b* and the second carrier may hold the third set of handles 23*a* and 23*b* walking in a column one facing the other's back for carrying the portable stretcher 100 and subject laying thereover. Alternatively, one carrier may hold handles 21*a* and 22*a*/23*a* and the other carrier handles 21*b* and 22*b*/23*b*.

Many alterations and modifications may be made by those having ordinary skill in the art without departing from the spirit and scope of the invention. Therefore, it must be understood that the illustrated embodiment has been set forth only for the purposes of example and that it should not be taken as limiting the invention as defined by the following invention and its various embodiments and/or by the following claims. For example, notwithstanding the fact that the elements of a claim are set forth below in a certain combination, it must be expressly understood that the invention includes other combinations of fewer, more or different elements, which are disclosed in above even when not initially claimed in such combinations. A teaching that two elements are combined in a claimed combination is further to be understood as also allowing for a claimed combination in which the two elements are not combined with each other, but may be used alone or combined in other combinations. The excision of any disclosed element of the invention is explicitly contemplated as within the scope of the invention.

The words used in this specification to describe the invention and its various embodiments are to be understood not only in the sense of their commonly defined meanings, but to include by special definition in this specification structure, material or acts beyond the scope of the commonly defined meanings. Thus if an element can be understood in the context of this specification as including more than one meaning, then its use in a claim must be understood as being generic to all possible meanings supported by the specification and by the word itself.

The definitions of the words or elements of the following claims are, therefore, defined in this specification to include not only the combination of elements which are literally set forth, but all equivalent structure, material or acts for performing substantially the same function in substantially the same way to obtain substantially the same result. In this sense it is therefore contemplated that an equivalent substitution of two or more elements may be made for any one of the elements in the claims below or that a single element may be substituted for two or more elements in a claim. Although elements may be described above as acting in certain combinations and even initially claimed as such, it is to be expressly understood that one or more elements from a claimed combination can in some cases be excised from the combination and that the claimed combination may be directed to a sub-combination or variation of a sub-combination.

Insubstantial changes from the claimed subject matter as viewed by a person with ordinary skill in the art, now known or later devised, are expressly contemplated as being equivalently within the scope of the claims. Therefore, obvious substitutions now or later known to one with ordinary skill in the art are defined to be within the scope of the defined elements.

The claims are thus to be understood to include what is specifically illustrated and described above, what is conceptually equivalent, what can be obviously substituted and also what essentially incorporates the essential idea of the invention.

Although the invention has been described in detail, nevertheless changes and modifications, which do not depart from the teachings of the present invention, will be evident to those skilled in the art. Such changes and modifications are deemed to come within the purview of the present invention and the appended claims.

What is claimed is:

1. A portable stretcher for carrying a subject, said stretcher comprising:

i) a support member for supporting a subject's body, said support member is made of a flexible material and comprising an upper section, a middle section and a lower section;

ii) at least two shoulder carrying straps, each shoulder carrying strap connecting the middle of the upper section to the bottom of the middle section, for allowing carrying said stretcher hands free by two carriers; and iii) at least two sets of handles connected to a support member, each set comprising at least one handle, wherein a first set of handles is connected to the proximal sides of the upper section and a second set of handles is connected to the distal sides of the lower section, wherein said stretcher is configured for carrying the subject in: (i) a sitting posture by having at least two carriers wearing said shoulder carrying straps; and (ii) a laying posture, in which the subject horizontally lays over said support member by having the carriers carry the laying subject by using said handles.

2. The stretcher according to claim 1, wherein said support member is made of fabric.

3. The stretcher according to claim 1, wherein said handles are made of a flexible material.

4. The stretcher according to claim 1, wherein said support member has parts that can fold and attach to one another in a folded position for adjusting the length of said support member to the stretcher positions.

5. The stretcher according to claim 4, wherein in a sitting position the support member is shorter than in a laying position thereof, said folded parts are releasably attached from one another by an attaching element.

6. The stretcher according to claim 5, wherein said attaching element comprises hoop-and-loop fasteners.

7. The stretcher according to claim 1, wherein said support member has a section thereof that is configured in a trapezoid shape to provide optimal load balance when supporting the subject's back or neck.

8. The stretcher according to claim 1 further comprising at least one fastening belt for securing the body of the subject to said support member.

9. The stretcher according to claim 1, wherein said stretcher further comprises a third handle set located at proximal sides of the middle section.

10. The stretcher according to claim 1, wherein each said shoulder carrying strap comprises a length adjustment mechanism for adjusting the length of the respective shoulder carrying strap according to its size and/or according to the required stretcher position.

11. The stretcher according to claim 10, wherein said portable stretcher includes two leg fastening belts for securing each of the subject's legs to said support member.

12. The stretcher according to claim 10, wherein said portable stretcher includes a main fastening belt for securing a subject's torso to said support member.

13. The stretcher according to claim 10, wherein each said fastening belt comprises an adjustment mechanism for adjusting the length thereof.

14. The stretcher according to claim 1 further comprising shoulder caps, wherein each said shoulder cap is configured for cladding each respective shoulder carrying strap.

* * * * *